US005820534A

United States Patent [19]

Vadher

[11] Patent Number: 5,820,534

[45] Date of Patent: Oct. 13, 1998

[54] BODY EXERCISE DEVICE

[76] Inventor: Dinesh L. Vadher, 20 Alta Vista, Belle Terre, N.Y. 11777

[21] Appl. No.: 903,247

[22] Filed: Jul. 24, 1997

[51] Int. Cl.[6] ..... A63B 21/02

[52] U.S. Cl. ..... 482/124; 482/125

[58] Field of Search ..... 482/121, 124, 482/125

[56] References Cited

U.S. PATENT DOCUMENTS 4,065,814 1/1978 Fox ..... 482/124
5,306,222 4/1994 Wilkinson ..... 482/124

*Primary Examiner*—Lynne A. Reichard

[57] ABSTRACT

A body exercise device that attaches to an exerciser and includes right and left members, right and left shoulder engaging apparatus, right and left knee engaging apparatus, right and left foot engaging apparatus, and right and left sole assemblies. The right and left members are elastic, elongated, slender, and formed as closed loops, and vertically encircle the right and left sides of the exerciser. The right and left shoulder engaging apparatus selectively maintains the right and left members against the right and left shoulders of the exerciser. The right and left waist engaging apparatus are capable of maintaining the right and left member against the exerciser's waist on both his front and back sides. The right and left knee engaging apparatus selectively maintain the right and left members against the right and left knees of the exerciser. The right and left knee engaging apparatus are capable of maintaining the right and left member against either the front or back of the exerciser's right and left knees. The right and left foot engaging apparatus selectively maintain the right and left members against the right and left feet of the exerciser.

21 Claims, 5 Drawing Sheets

BODY EXERCISE DEVICE

BACKGROUND OF THE INVENTION

1. Field of the Invention

The present invention relates to an exercise device. More particularly, the present invention relates to a body exercise device.

2. Description of the Prior Art

Physical fitness is recognized as essential to good health and longevity. For example, one of the leading causes of death in the United States is heart disease.

Modern people increasingly find themselves working at jobs which are sedentary or which require less and less physical exercise. As a consequence, in order to maintain physical fitness, many people turn to fitness centers, aerobic exercises, and other forms of recreational activity to develop or maintain good physical condition of their bodies.

Fitness centers typically include a variety of equipment on which the members perform various exercises for developing the muscle tone and building muscles in different parts of their bodies. There are rowing machines, stair climbing machines, treadmills, weight lifting machines in a wide variety of configurations. Machines of this type, however, are relatively bulky, and for that reason, generally are found only in commercial fitness centers.

Machines are sold for home use, but each machine requires substantial storage space in the home. Frequently, any given machine is capable only of exercising some, but not all, of the muscles in a person's body.

Aerobic exercise, is an important element in achieving and maintaining physical fitness. Numerous studies have shown that consistent aerobic exercise will significantly reduce the risk factors associated with heart disease.

Aerobic exercise is available through many sports and activities, each with certain advantages and limitations. Cross-country skiing has long been regarded by fitness experts as one of the best overall aerobic activities because it is a total body endurance sport that aerobically conditions both the upper and lower body.

Unfortunately, only a relatively small number of people have access to cross-country ski areas, and the sport is, of course, subject to season and weather. There are cross-country ski simulators, but those currently available require a high level of skill to use, are expensive, and provide resistance through a limited range of motion which reduces the effectiveness of the activity.

Other activities are more widely available. Currently, the most popular modes of aerobic exercise are walking, jogging, aerobic dance, stair-stepping, and stationary cycling. Although these activities are beneficial if performed regularly, they do little to aerobically condition or tone the muscles of the upper body.

In an effort to increase the effectiveness of such activities, some individuals have used hand-held weights. Several studies have shown, however, that hand-weights are ineffective in enhancing weight loss or significantly improving cardiovascular parameters. Further, because of the ballistic nature of the forces involved, hand weight users are more prone to shoulder injuries.

Numerous innovations for body exercise devices have been provided in the prior art that will be described. Even though these innovations may be suitable for the specific individual purposes to which they address, however, they differ from the present invention.

FOR EXAMPLE, U.S. Pat. No. 5,186,701 to Wilkinson teaches an aerobic exercise garment that includes an article of clothing worn on the body with an anchor member worn at the hand or foot. A connecting element is connected to the article of clothing and the anchor member. The connecting element is preferably made of an elastic material so as to offer resistance during the movement of the arm or leg in a motion exercise.

ANOTHER EXAMPLE, U.S. Pat. No. 5,203,754 to Maclean teaches a variable resistance leg harness exercise apparatus that includes a belt, leg attachments, foot attachments, and stretchable cords attached to the belt and to the leg, and foot attachments for enabling the user to perform under increased load while not changing the user's natural center of gravity and without distorting the natural patterns of the exercise being performed.

STILL ANOTHER EXAMPLE, U.S. Pat. No. 5,256,119 to Tudor teaches an exercise harness for restricting hyperextension of a wearer's legs when worn by the wearer in an upright position. The harness includes a waist belt with depending leg straps located against the back of the wearer's legs and connected to foot stirrups. The straps have knee bends to retain the straps against the legs and adjustment structure to adjust the length of the straps and the resulting degree of hyperextension of the wearer's legs.

YET ANOTHER EXAMPLE, U.S. Pat. No. 5,308,305 to Romney teaches an apparatus for augmenting exercise of body muscles that includes one or more articles of close-fitting wearing apparel employing one or more removable elongate resistance members, loosely enclosed in passageways along a portion of the length of the apparel. The resistance members are releasibly anchored at one end to a fixed-in-place member such as a belt or a shoulder harness and attached at the distal end to the extremity of an arm or leg. The apparatus is devised so as to increase the energy required by a user to flex his arms or legs over the energy level necessary without the resistance of the elongate resistance members.

STILL YET ANOTHER EXAMPLE, U.S. Pat. No. 5,336,151 to Van Ballegooie teaches a body exercise device that includes a waist belt which is releasibly fastened on the waist of a user. A plurality of snap rings are pivotally attached to the belt at spaced intervals throughout its length to provide different attachment locations for elongated elastic members. The elastic members have snap hooks connected at opposite ends, with one end of each elastic member connecting to a selected one of the snap rings on the belt. Foot pieces are provided for each foot of the user. Each of the foot pieces has a snap ring on it for attachment to a snap hook on the opposite end of an elastic member. Hand pieces also are provided for each hand and include a hand-encircling portion and a wrist protector portion with a swivel snap ring on them to which a snap hook on the opposite end of a corresponding elastic member is attached. The foot members also have swivel snap rings located on an ankle extending portion on the inside of each ankle for connection to an additional elastic member by means of snap hooks located on each end. Various exercises can be performed by the exercise device and different muscles may be exercised by connecting the elastic members to different ones of the snap rings on the waist encircling member, in accordance with the exercise to be performed.

YET STILL ANOTHER EXAMPLE, U.S. Pat. No. 5,357,637 to Moore teaches an elastic band attachable above the knees of the wearer to the sides of pants being worn. The elastic band has attachment devices secured to the elastic band which are fastened to attachment devices on the pants. As the wearer walks or cycles, the elastic band resistance is provided to the leg muscles and provides a form of aerobic exercise.

FINALLY, STILL YET ANOTHER EXAMPLE, U.S. Pat. No. 5,362,295 to Nurge teaches an exercise system which exercises the musculature of the upper body while simultaneously performing a lower body aerobic exercise. The system includes a belt, a variety of elastic cords, a variety of hand grips, ankle straps, and foot straps. Variable resistance is provided by an elastic cord which is free to slide about the user's waist. The elastic cords are provided with clip-hooks at each end which allow them to be easily attached to and detached from the belt and the straps. Additionally, a wrist attachment is disclosed.

It is apparent that numerous innovations for body exercise devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a body exercise device that avoids the disadvantages of the prior art.

ANOTHER OBJECT of the present invention is to provide a body exercise device that is simple and inexpensive to manufacture.

STILL ANOTHER OBJECT of the present invention is to provide a body exercise device that is simple to use.

BRIEFLY STATED, YET ANOTHER OBJECT of the present invention is to provide a body exercise device that attaches to an exerciser and includes right and left members, right and left shoulder engaging apparatus, right and left knee engaging apparatus, right and left foot engaging apparatus, and right and left sole assemblies. The right and left members are elastic, elongated, slender, and formed as closed loops, and vertically encircle the right and left sides of the exerciser. The right and left shoulder engaging apparatus selectively maintains the right and left members against the right and left shoulders of the exerciser. The right and left waist engaging apparatus are capable of maintaining the right and left member against the exerciser's waist on both his front and back sides. The right and left knee engaging apparatus selectively maintain the right and left members against the right and left knees of the exerciser. The right and left knee engaging apparatus are capable of maintaining the right and left member against either the front or back of the exerciser's right and left knees. The right and left foot engaging apparatus selectively maintain the right and left members against the right and left feet of the exerciser.

The present invention simultaneously strengthens most of the body muscles, thus, making the bones stronger, and is used in many medical conditions to prevent and heal , inclusive of osteoporosis, muscle wasting diseases, chronic fatigue syndrome, and after major surgery, such as orthopedic.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawing.

DESCRIPTION OF THE DRAWING

The figures of the drawing are briefly described as follows.

DETAILED DESCRIPTION OF THE PREFERRED EMBODIMENT

Figure 1:
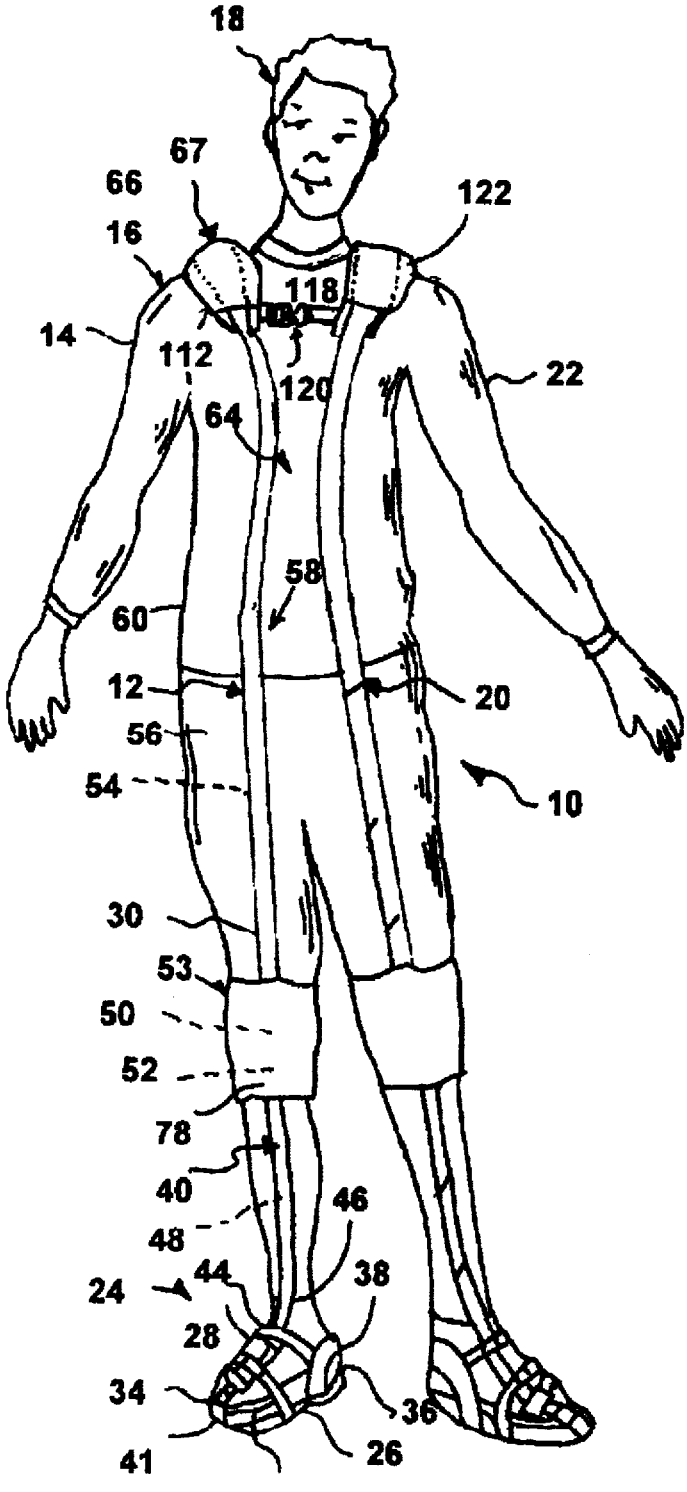
FIG. 1 is a diagrammatic front perspective view of the present invention donned by an exerciser.
Figure 2:
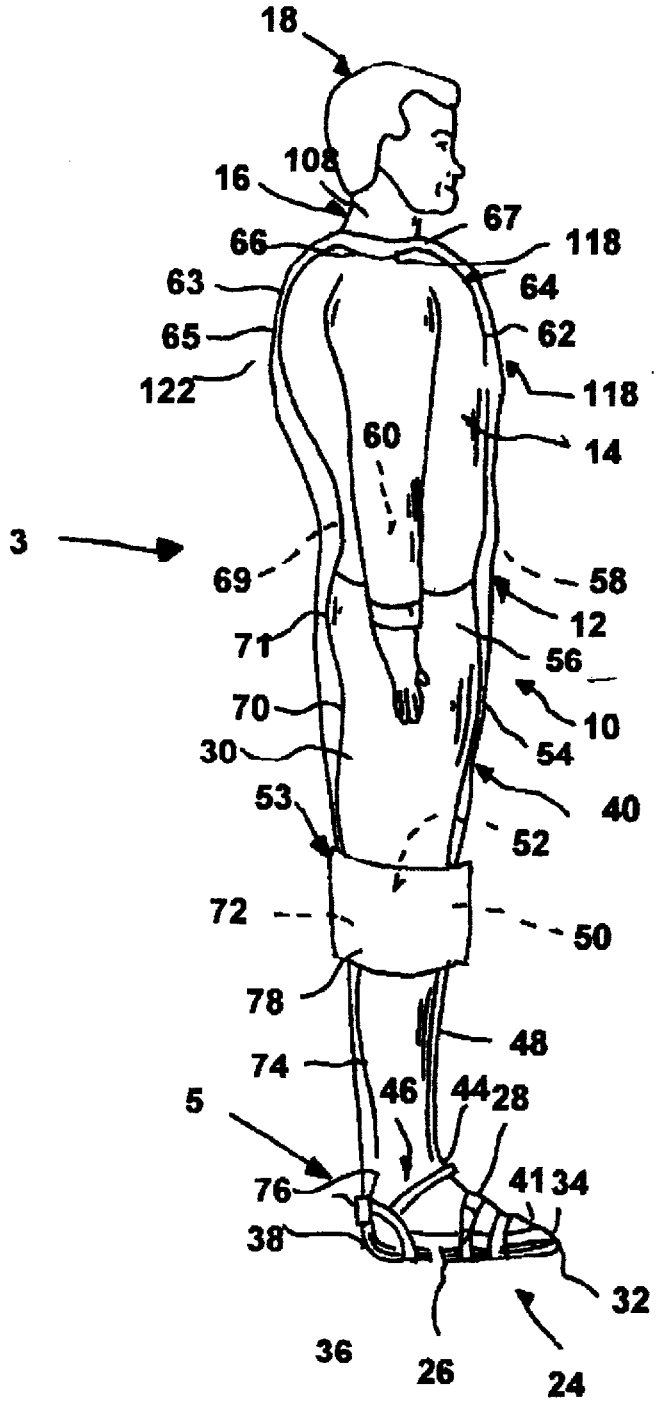
FIG. 2 is a diagrammatic side perspective view of the present invention donned by the exerciser, taken generally in the direction of ARROW 2 in FIG. 1.
Figure 3:
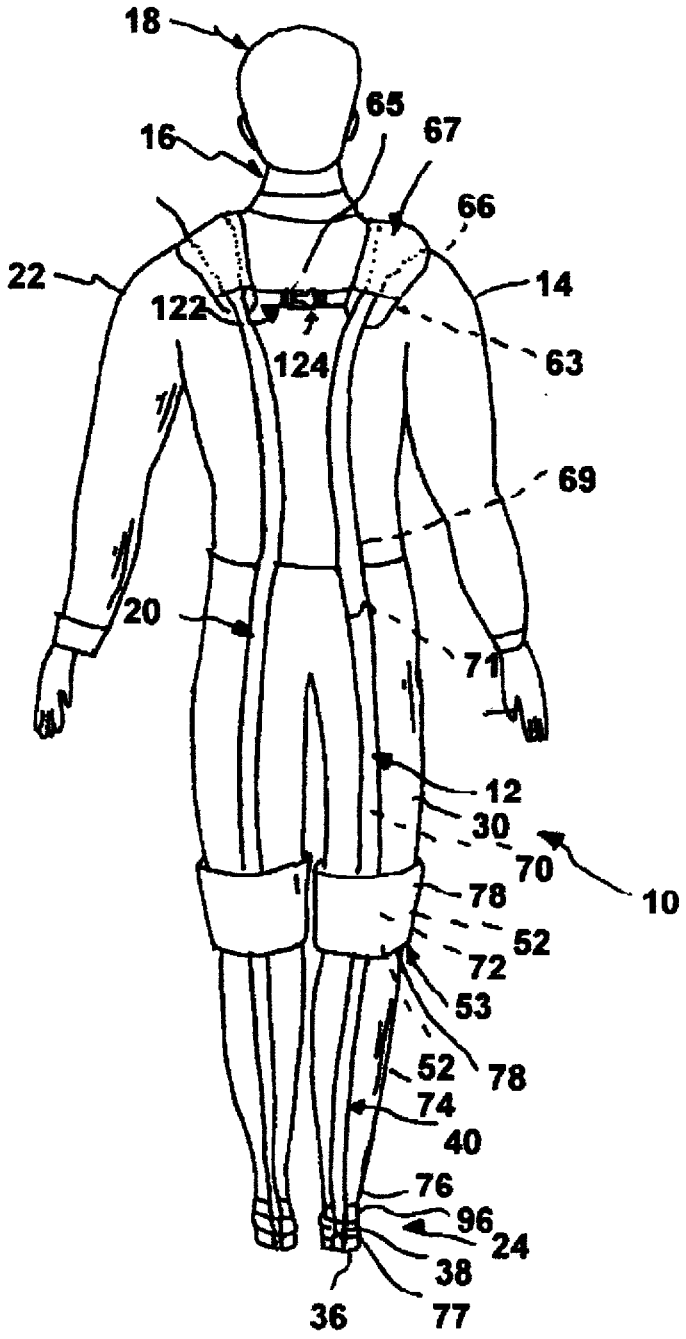
FIG. 3 is a diagrammatic rear perspective view of the present invention donned by the exerciser, taken generally in the direction of ARROW 3 in FIG. 2.

Referring now to the figures in which like numerals indicate like parts, and particularly to FIG. 1, FIG. 2, and FIG. 3, the body exercise device of the present invention is shown generally at 10 and includes a right side member 12 that is elastic, elongated, slender, and formed as a closed loop and vertically encircles a right side 14 of a body 16 of an exerciser 18, and a left side member 20 that is elastic, elongated, slender, and formed as a closed loop and vertically encircles a left side 22 of the body 16 of the exerciser 18.

The configuration of the right side member 12, and the left side member 20 can best be seen in FIG. 1, FIG. 2, and FIG. 3, and as such will be discussed with reference thereto.

It is to be understood, however, that since the configuration of the left side member 20 is identical to that of the right side member 12, for the sake of brevity, only the right side member 12 will be discussed.

The right side member 12 includes a right sole assembly 24 that is positioned on a sole 26, i.e., inter alia, the general area of the Plantar Region, of the right foot 28, i.e., inter alia, the general area of the Tarsus, of a right leg 30 of the right side 14 of the body 16 of the exerciser 18 when the body exercise device 10 is being utilized.

The right sole assembly 24 of the right side member 12 has a toe area 32 that is positioned under toes 34 of the right foot 28 of the right leg 30 of the right side 14 of the body 16 of the exerciser 18 when the body exercise device 10 is being utilized, and a heel area 36 that is positioned under a heel 38, i.e., inter alia, the general area of the Calcaneum or Os Calcis, of the right foot 28 of the right leg 30 of the right side 14 of the body 16 of the exerciser 18 when the body exercise device 10 is being utilized.

The right side member 12 further includes a strap 40 that is one-piece, continuous, elastic, elongated, and slender, and may be of different thicknesses, widths, and elasticity is releasibly attached at one end thereof by a first quick release buckle 41 or in the alternative may be fixedly attached or unitary and extends continuously vertically upwardly from, the toe area 32 of the right sole assembly 24 of the right side member 12, continuously vertically upwardly along an instep 42, i.e., inter alia, the general area of the tarsal, of the right foot 28 of the right leg 30 of the right side 14 of the body 16 of the exerciser 18, where it is selectively maintained thereagainst by the right sole assembly 24 of the right side member 12, to an anterior portion 44, i.e., inter alia, the general area of the Tibialis Anticus, of an ankle 46 of the right leg 30 of the right side 14 of the body 16 of the exerciser 18 when the body exercise device 10 is being utilized.

The strap 40 of the right side member 12 further extends continuously vertically upwardly from the anterior portion 44 of the ankle 46 of the right leg 30 of the right side 14 of the body 16 of the exerciser 18, continuously vertically upwardly along a shin 48, i.e., inter alia, the general area of the Tibia, of the right leg 30 of the right side 14 of the body 16 of the exerciser 18, to an anterior portion 50, i.e., inter alia, the general area of the Patella, of a knee 52 of the right leg 30 of the right side 14 of the body 16 of the exerciser 18, where it is selectively maintained thereagainst by a right knee maintaining apparatus 53 when the body exercise device 10 is being utilized.

The strap 40 of the right side member 12 further extends continuously vertically upwardly from the anterior portion 50 of the knee 52 of the right leg 30 of the right side 14 of the body 16 of the exerciser 18, continuously vertically upwardly along an anterior portion 54, i.e., inter alia, the general area of the Quadriceps Extensor, of a thigh 56 of the right leg 30 of the right side 14 of the body 16 of the exerciser 18, to an anterior portion 58, i.e., inter alia, the general area of the Poupart's Ligament, of a waist 60 of the body 16 of the exerciser 18 when the body exercise device 10 is being utilized.

The strap 40 of the right side member 12 further extends continuously vertically upwardly from the anterior portion 58 of the waist 60 of the body 16 of the exerciser 18, continuously vertically upwardly along a right breast 62, i.e., inter alia, the general area of the Pectoris Major, of a chest 64, i.e., inter alia, the general area of the Anterior Thoracic Region, of the body 16 of the exerciser 18, to a right shoulder 66, i.e., inter alia, the general area of the Clavicle, of the body 16 of the exerciser 18, where it widens to a wide right shoulder strap 67 when the body exercise device 10 is being utilized.

The strap 40 of the right side member 12 further extends continuously rearwardly along, and continuously vertically downwardly from, the right shoulder 66 of the body 16 of the exerciser 18, continuously vertically downwardly along a right side 63, i.e., inter alia, the general area of the Trapezius, of a back 65 of the body 16 of the exerciser 18, to a right back 69, i.e., inter alia, the general area of the Latissimus Dorsi, of the waist 60 of the body 16 of the exerciser 18 when the body exercise device 10 is being utilized.

The strap 40 of the right side member 12 further extends continuously vertically downwardly from the right back 69 of the waist 66 of the body 16 of the exerciser 18, continuously vertically downwardly along a right buttocks 71, i.e., inter alia, the general area of the Gluteus Maximus, of the right leg 30 of the right side 14 of the body 16 of the exerciser 18, continuously vertically downwardly along a posterior portion 70, i.e., inter alia, the general area of the Biceps Flexor Cruris, of the thigh 56 of the right leg 30 of the right side 14 of the body 16 of the exerciser 18, to a posterior portion 72, i.e., inter alia, the general area of the popliteal space, of the knee 52 of the right leg 30 of the right side 14 of the body 16 of the exerciser 18, where it is selectively maintained thereagainst by the right knee maintaining apparatus 53 of the right side member 12 when the body exercise device 10 is being utilized.

The strap 40 of the right side member 12 further extends continuously vertically downwardly from the posterior portion 72 of the knee 52 of the right leg 30 of the right side 14 of the body 16 of the exerciser 18, continuously vertically downwardly along a calf 74, i.e., inter alia, the general area of the Gastrocnemius, of the right leg 30 of the right side 14 of the body 16 of the exerciser 18, to a posterior portion 76, i.e., inter alia, the general area of the Tendo Achillis, of the ankle 46 of the right leg 30 of the right side 14 of the body 16 of the exerciser 18 when the body exercise device 10 is being utilized.

The strap 40 of the right side member 12 further extends continuously vertically downwardly from the posterior portion 76 of the ankle 46 of the right leg 30 of the right side 14 of the body 16 of the exerciser 18, continuously vertically downwardly along the heel 38 of the right foot 28 of the right leg 30 of the right side 14 of the body 16 of the exerciser 18, to the heel area 36 of the right sole assembly 24 of the right side member 12, where it is releasibly attached thereto by a second quick release buckle 77 or in the alternative may be fixedly attached or unitary when the body exercise device 10 is being utilized.

The right knee maintaining apparatus 53 of the right side member 12 includes an elastic sleeve 78 that replaceably and snugly encircles the knee 52 of the right leg 30 of the right side 14 of the body 16 of the exerciser 18 when the body exercise device 10 is being utilized.

The elastic sleeve 78 of the right knee maintaining apparatus 53 of the right side member 12 vertically sandwiches the strap 40 of the right side member 12 that extends continuously vertically along the anterior portion 50 of the knee 52 of the right leg 30 of the right side 14 of the body 16 of the exerciser 18 against the anterior portion 50 of the right knee 52 of the right leg 30 of the right side 14 of the body 16 of the exerciser 18 and vertically sandwiches the strap 40 of the right member 12 that extends continuously vertically along the posterior portion 72 of the right knee 52 of the right leg 30 of the right side 14 of the body 16 of the exerciser 18 against the posterior portion 72 of the right knee 52 of the right leg 30 of the right side 14 of the body 16 of the exerciser 18 when the body exercise device 10 is being utilized.

The body exercise device 10 further includes an upper body front retaining strap 118 that is releasible and flexible and releasibly, and draws together the strap 40 of the right side member 12 and the strap of the left side member 20, in the area of the chest 64 of the body 16 of the exerciser 18, by a quick release buckle 121.

The body exercise device 10 further includes an upper body back retaining strap 122 that is releasible and flexible and releasibly draws together the strap 40 of the right side member 12 and the strap of the left side member 20, in the area of the back 65 of the body 16 of the exerciser 18, by a quick release buckle.

Figure 4:
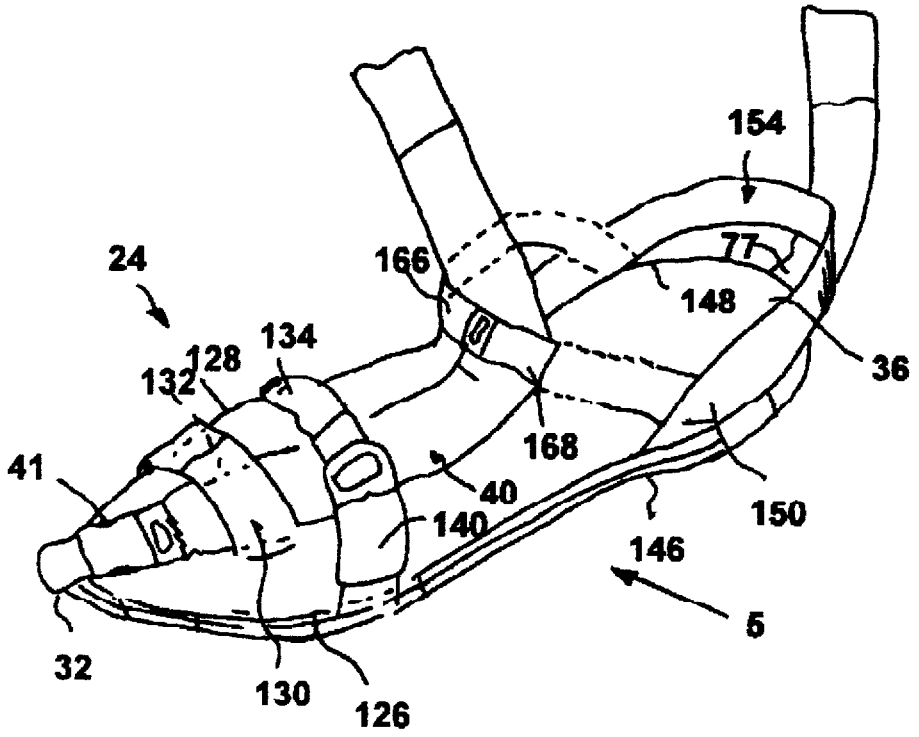
FIG. 4 is an enlarged side perspective view of the improved foot covering assembly.
Figure 5:
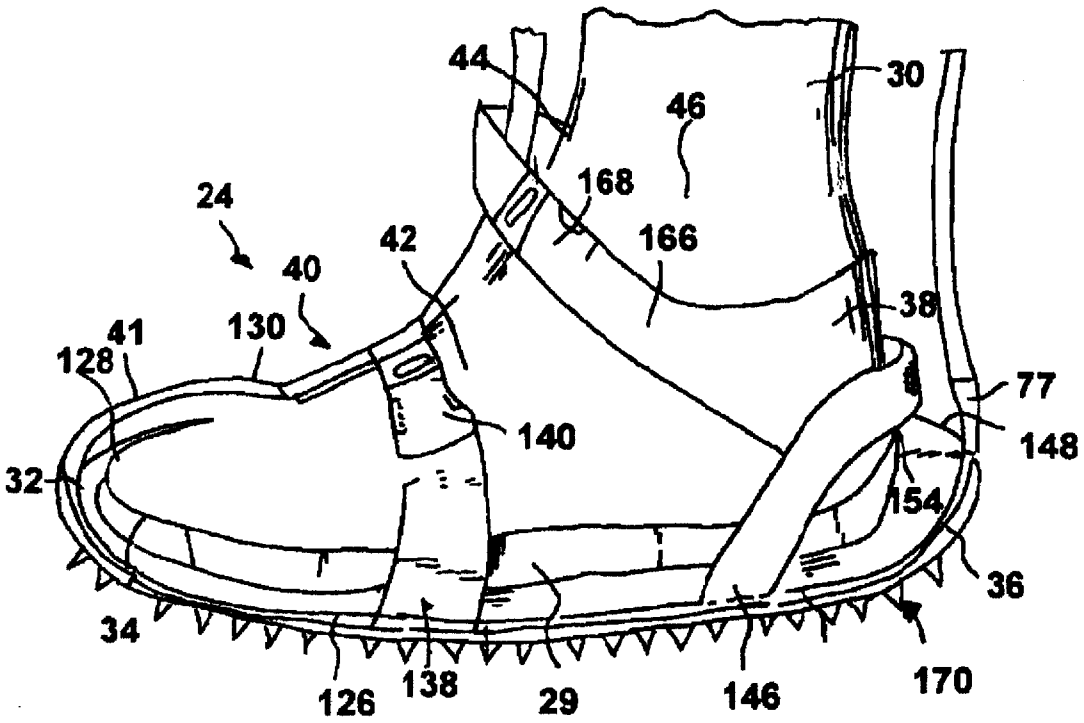
FIG. 5 is an enlarged side perspective view of the improved foot covering assembly donned on a foot of the exerciser, taken in the area generally enclosed by the broken ellipse identified by ARROW 5 in FIG. 2 and in the general direction of ARROW 5 in FIG. 4.

The configuration of the right sole assembly 24 of the right side member 12, can best be seen in FIG. 4 and FIG. 5, and as such will be discussed with reference thereto.

The toe area 32 of the right sole assembly 24 of the right side member 12 has a first longitudinal side 126 that is convex-shaped, and a second longitudinal side 128 that is convex-shaped and spaced from, and opposes, the first longitudinal side 126 of the toe area 32 of the right sole assembly 24 of the right side member 12.

The right sole assembly 24 of the right side member 12 includes a first toe strap 130 that is slender and flexible, and extends vertically upwardly from the second longitudinal side 128 of the toe area 32 of the right sole assembly 24 of the right side member 12, underneath, around, and over the strap 40 of the right side member 12 where it doubles back onto itself, which abuts against an upper portion of at least one toe of the toes 34 of the right foot 28 of the right leg 30 of the right side 14 of the body 16 of the exerciser 18 when the body exercise device 10 is being utilized.

The right sole assembly 24 of the right side member 12 further includes a second toe strap 138 that is slender and flexible, and extend vertically upwardly from the second longitudinal side 128 of the toe area 32 of the right sole assembly 24 of the right side member 12, over the instep 42 of the foot 28 of the right leg 30 of the right side 14 of the body 16 of the exerciser 18, to the first longitudinal side 126 of the toe area 32 of the right sole assembly 24 of the right side member 12, and is disposed rearwardly of the first toe strap 130 of the right sole assembly 24 of the right side member 12, and abuts against the instep 42 of the foot 28 of the right leg 30 of the right side 14 of the body 16 of the exerciser 18 when the body exercise device 10 is being utilized.

The second toe strap 138 of the right sole assembly 24 of the right side member 12 is divided into two parts that are releasibly maintained to each other by a third quick release buckle 140, and overlaps the strap 40 of the right side member 12 when the body exercise device 10 is being utilized.

The heel area 36 of the right sole assembly 24 of the right side member 12 has a first longitudinal side 146 that is convex-shaped and continuous with the first longitudinal side 126 of the toe area 32 of the right sole assembly 24 of the right side member 12.

The heel area 36 of the right sole assembly 24 of the right side member 12 further has a second longitudinal side 148 that is convex-shaped and continuous with the second longitudinal side 128 of the toe area 32 of the right sole assembly 24 of the right side member 12, and spaced from, and opposing, the first longitudinal side 146 of the heel area 36 of the right sole assembly 24 of the right side member 12.

The right sole assembly 24 of the right side member 12 further includes a heel strap 150 that is flexible and extends obliquely- rearwardly-upwardly from the first longitudinal side 146 of the heel area 36 of the right sole assembly 24 of the right side member 12, around the heel 38 of the foot 28 of the right leg 30 of the right side 14 of the body 16 of the exerciser 18, and obliquely-forwardly-downwardly to the second longitudinal side 148 of the heel area 36 of the right sole assembly 24 of the right side member 12, and abuts against the heel 38 of the foot 28 of the right leg 30 of the right side 14 of the body 16 of the exerciser 18 when the body exercise device 10 is being utilized.

The right sole assembly 24 of the right side member 12 further includes an instep strap 166 that is flexible and extends generally obliquely-forwardly-upwardly from the heel strap 150 of the right sole assembly 24 of the right side member 12, in the area of the first longitudinal side 146 of the heel area 36 of the right sole assembly 24 of the right side member 12, over the instep 42 of the right foot 28 of the right leg 30 of the right side 14 of the body 16 of the exerciser 18, obliquely-rearwardly-downwardly to the heel strap 150 of the right sole assembly 24 of the right side member 12, in the area of the second longitudinal side 148 of the heel area 36 of the right sole assembly 24 of the right side member 12 when the body exercise device 10 is being utilized.

The instep strap 166 of the right sole assembly 24 of the right side member 12 is divided into two parts that are releasibly maintained to each other by a fourth quick release buckle 168, and overlaps the strap 40 of the right side member 12 when the body exercise device 10 is being utilized.

The right sole assembly 24 further includes spikes 170 extending downwardly therefrom which are similar to those used by sprinters, and would be used by athletes, especially sprinters, for training so as to improve performance, time, and endurance.

It will be understood that each of the elements described above, or two or more together, may also find a useful application in other types of constructions differing from the types described above.

While the invention has been illustrated and described as embodied in a body exercise device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A body exercise device attachable to an exerciser, comprising:

a) a right member being elastic, elongated, slender, and formed as a closed loop for vertically encircling the right side of the exerciser;

b) right shoulder engaging means for selectively maintaining said right member against the right shoulder of the exerciser;

c) right knee engaging means for selectively maintaining said right member against the right knee of the exerciser; said right knee engaging means being capable of maintaining said right member against either the front or back of the exerciser's right knee;

d) right foot engaging means for selectively maintaining said right member against the right foot of the exerciser;

e) a right sole assembly attached to said right foot engaging means and having a toe area and a heel area; said right foot maintaining means including said right sole assembly; said right member including a strap being one-piece, continuous, elastic, elongated, and slender, and having a length and a tension, and being releasibly attached at one end thereof by a quick release buckle to, and extending continuously vertically upwardly from, said toe area of said right sole assembly, continuously vertically upwardly along the right instep of the exerciser, where it is selectively maintained thereagainst by said right sole assembly, to the anterior portion of the right ankle of the exerciser when said body exercise device is being utilized;

f) a left member being elastic, elongated, slender, and formed as a closed loop for vertically encircling the left side of the exerciser;

g) left shoulder engaging means for selectively maintaining said left member against the left shoulder of the exerciser;

h) left knee engaging means for selectively maintaining said left member against the left knee of the exerciser;

said left knee engaging means being capable of maintaining said left member against either the front or back of the exerciser's right knee;

i) left foot engaging means for selectively maintaining said left member against the left foot of the exerciser; and j) a left sole assembly attached to said left foot engaging means and having a toe area and a heel areas; said left foot maintaining means including said left sole assembly; said left member including a strap being one-piece, continuous, elastic, elongated, and slender, and having a length and a tension, and being releasibly attached at one end thereof by a quick release buckle to, and extending continuously vertically upwardly from, said toe area of said left sole assembly, continuously vertically upwardly along the left instep of the exerciser, where it is selectively maintained thereagainst by said left sole assembly, to the anterior portion of the left ankle of the exerciser when said body exercise device is being utilized.

2. The device as defined in claim 1, wherein said strap of said right member further extends continuously vertically upwardly from the anterior portion of the right ankle of the exerciser, continuously vertically upwardly along the right shin of the exerciser, to the anterior portion of the right knee of the exerciser, where it is selectively maintained thereagainst by said right knee maintaining means when said body exercise device is being utilized; said strap of said left member further extends continuously vertically upwardly from the anterior portion of the left ankle of the exerciser, continuously vertically upwardly along the left shin of the exerciser, to the anterior portion of the left knee of the exerciser, where it is selectively maintained thereagainst by said left knee maintaining means when said body exercise device is being utilized.

3. The device as defined in claim 2, wherein said strap of said right member further extends continuously vertically upwardly from the anterior portion of the right knee of the exerciser, continuously vertically upwardly along the anterior portion of the right thigh of the exerciser, to the right anterior portion of the waist of the exerciser when said body exercise device is being utilized; said strap of said left member further extends continuously vertically upwardly from the anterior portion of the left knee of the exerciser, continuously vertically upwardly along the anterior portion of the left thigh of the exerciser, to the left anterior portion of the waist of the exerciser when said body exercise device is being utilized.

4. The device as defined in claim 3, wherein said strap of said right member further extends continuously vertically upwardly from the right anterior portion of the waist of the exerciser, continuously vertically upwardly along the right breast of the exerciser, to the right shoulder of the exerciser, where it is selectively maintained thereagainst by said right shoulder maintaining means when said body exercise device is being utilized; said strap of said left member further extends continuously vertically upwardly from the left anterior portion of the waist of the exerciser, continuously vertically upwardly along the left breast of the exerciser, to the left shoulder of the exerciser, where it is selectively maintained thereagainst by said left shoulder maintaining means when said body exercise device is being utilized.

5. The device as defined in claim 4, wherein said strap of said right member further extends continuously rearwardly along, and continuously vertically downwardly from, the right shoulder of the exerciser, continuously vertically downwardly along the right portion of the back of the exerciser, to the right posterior portion of the waist of the exerciser when said body exercise device is being utilized; said strap of said left member further extends continuously rearwardly along, and continuously vertically downwardly from, the left shoulder of the exerciser, continuously vertically downwardly along the left portion of the back of the exerciser, to the left posterior portion of the waist of the exerciser when said body exercise device is being utilized.

6. The device as defined in claim 5, wherein said strap of said right member further extends continuously vertically downwardly from the right posterior portion of the waist of the exerciser, continuously vertically downwardly along the right buttocks of the exerciser, continuously vertically downwardly along the posterior portion of the right thigh of the exerciser, to the posterior portion of the right knee of the exerciser, where it is selectively maintained thereagainst by said right knee maintaining means when said body exercise device is being utilized; said strap of said left member further extends continuously vertically downwardly from the left posterior portion of the waist of the exerciser, continuously vertically downwardly along the left buttocks of the exerciser, continuously vertically downwardly along the posterior portion of the left thigh of the exerciser, to the posterior portion of the left knee of the exerciser, where it is selectively maintained thereagainst by said left knee maintaining means when said body exercise device is being utilized.

7. The device as defined in claim 6, wherein said strap of said right member further extends continuously vertically downwardly from the posterior portion of the right knee of the exerciser, continuously vertically downwardly along the right calf of the exerciser, to the posterior portion of the right ankle of the exerciser when said body exercise device is being utilized; said strap of said left member further extends continuously vertically downwardly from the posterior portion of the left knee of the exerciser, continuously vertically downwardly along the left calf of the exerciser, to the posterior portion of the left ankle of the exerciser when said body exercise device is being utilized.

8. The device as defined in claim 7, wherein said strap of said right member further extends continuously vertically downwardly from the posterior portion of the right ankle of the exerciser, continuously vertically downwardly along the right heel of the exerciser, to said heel area of said right sole assembly, where another end thereof is releasibly attached thereto by a quick release buckle when said body exercise device is being utilized; said strap of said left member further extends continuously vertically downwardly from the posterior portion of the left ankle of the exerciser, continuously vertically downwardly along the left heel of the exerciser, to said heel area of said left sole assembly, where another end thereof is releasibly attached thereto by a quick release buckle when said body exercise device is being utilized.

9. The device as defined in claim 2, wherein said right knee maintaining means includes an elastic sleeve that replaceably and snugly encircles the right knee of the exerciser when said body exercise device is being utilized, and vertically sandwiches said strap of said right side member that extends continuously vertically along the anterior portion of the right knee of the exerciser against the anterior portion of the right knee of the exerciser and vertically sandwiches said strap of said right member that extends continuously vertically along the anterior portion of the left knee of the exerciser against the anterior portion of the left knee of the exerciser and vertically sandwiches said strap of said left member that extends continuously vertically along the posterior portion of the left knee of the exerciser against the posterior portion of the left knee of the exerciser when said body exercise device is being utilized.

10. The device as defined in claim 4, wherein said right shoulder maintaining means includes said strap of said right member being widened where said strap of said right member abuts against the right shoulder of the exerciser when said body exercise device is being utilized; said left shoulder maintaining means includes said strap of said left member being widened where said strap of said left member abuts against the left shoulder of the exerciser when said body exercise device is being utilized.

11. The device as defined in claim 4; further comprising an anterior retaining strap being adjustable, releasible, and flexible, and releasibly drawing together said strap of said right member and said strap of said left member, at the chest of the exerciser when said body exercise device is being utilized, and being selectively released by a quick release buckle.

12. The device as defined in claim 1, wherein said toe area of said right sole assembly has a first convex-shaped longitudinal side, and a second convex-shaped longitudinal side that is spaced from, and opposes said first convex-shaped longitudinal side of said toe area of said right sole assembly; said toe area of said left sole assembly has a first convex-shaped longitudinal side, and a second convex-shaped longitudinal side that is spaced from, and opposes said first convex-shaped longitudinal side of said toe area of said left sole assembly.

13. The device as defined in claim 12, wherein said right sole assembly includes a first toe strap that abuts against an upper portion of at least one toe of the toes of the right foot of the exerciser when said body exercise device is being utilized, and is slender and flexible, and extends vertically upwardly from said second longitudinal side of said toe area of said right sole assembly, underneath, around, and over said strap of said right member where it doubles back onto itself and is adjustably maintained on itself by hook and loop fasteners; said left sole assembly includes a first toe strap that abuts against an upper portion of at least one toe of the toes of the left foot of the exerciser when said body exercise device is being utilized, and is slender and flexible, and extends vertically upwardly from said second longitudinal side of said toe area of said left sole assembly, underneath, around, and over said strap of said left member where it doubles back onto itself and is adjustably maintained on itself by hook and loop fasteners.

14. The device as defined in claim 13, wherein said right sole assembly further includes a second toe strap that is slender and flexible, and extends vertically upwardly from said second longitudinal side of said toe area of said right sole assembly, over and abuts against the right instep of the exerciser when said body exercise device is being utilized, to said first longitudinal side of said toe area of said right sole assembly, and is disposed rearwardly of said first toe strap of said right sole assembly; said left sole assembly further includes a second toe strap that is slender and flexible, and extends vertically upwardly from said second longitudinal side of said toe area of said left sole assembly, over and abuts against the left instep of the exerciser when said body exercise device is being utilized, to said first longitudinal side of said toe area of said left sole assembly, and is disposed rearwardly of said first toe strap of said left sole assembly.

15. The device as defined in claim 14, wherein said second toe strap of said right sole assembly overlaps said strap of said right member when said body exercise device is being utilized, and is divided into two parts that are releasibly maintained to each other by a quick release buckle; said second toe strap of said left sole assembly overlaps said strap of said left member when said body exercise device is being utilized, and is divided into two parts that are releasibly maintained to each other by a quick release buckle.

16. The device as defined in claim 12, wherein said heel area of said right sole assembly has a first longitudinal side that is convex-shaped and continuous with said first longitudinal side of said toe area of said right sole assembly; said heel area of said left sole assembly has a first longitudinal side that is convex-shaped and continuous with said first longitudinal side of said toe area of said left sole assembly.

17. The device as defined in claim 16, wherein said heel area of said right sole assembly further has a second longitudinal side that is convex-shaped and continuous with said second longitudinal side of said toe area of said right sole assembly, and spaced from, and opposes, said first longitudinal side of said heel area of said right sole assembly; said heel area of said left sole assembly further has a second longitudinal side that is convex-shaped and continuous with said second longitudinal side of said toe area of said left sole assembly, and spaced from, and opposes, said first longitudinal side of said heel area of said left sole assembly.

18. The device as defined in claim 17, wherein said right sole assembly further includes a heel strap that is flexible and extends obliquely-rearwardly-upwardly from said first longitudinal side of said heel area of said right sole assembly, around and abuts against the right heel of the exerciser when said body exercise device is being utilized, and obliquely-forwardly-downwardly to said second longitudinal side of said heel area of said right sole assembly; said left sole assembly further includes a heel strap that is flexible and extends obliquely-rearwardly-upwardly from said first longitudinal side of said heel area of said left sole assembly, around and abuts against the left heel of the exerciser when said body exercise device is being utilized, and obliquely-forwardly-downwardly to said second longitudinal side of said heel area of said left sole assembly.

19. The device as defined in claim 18, wherein said right sole assembly further includes an instep strap that is flexible and extends generally obliquely-forwardly-upwardly from said heel strap of said right sole assembly, in proximity of said first longitudinal side of said heel area of said right sole assembly, over the right instep of said exerciser when said body exercise device is being utilized, obliquely-rearwardly-downwardly to said heel strap of said right sole assembly, in proximity of said second longitudinal side of said heel area of said right sole assembly; said left sole assembly further includes an instep strap that is flexible and extends generally obliquely-forwardly-upwardly from said heel strap of said left sole assembly, in proximity of said first longitudinal side of said heel area of said left sole assembly, over the left instep of said exerciser when said body exercise device is being utilized, obliquely-rearwardly-downwardly to said heel strap of said left sole assembly, in proximity of said second longitudinal side of said heel area of said left sole assembly.

20. The device as defined in claim 19, wherein said instep strap of said right sole assembly overlaps said strap of said right member when said body exercise device is being utilized, and is divided into two parts that are releasibly maintained to each other by a quick release buckle; said instep strap of said left sole assembly overlaps said strap of said left member when said body exercise device is being utilized, and is divided into two parts that are releasibly maintained to each other by a quick release buckle.

21. The device as defined in claim 1, wherein said right sole assembly includes spikes extending downwardly therefrom; said left sole assembly includes spikes extending downwardly therefrom.

* * * * *